US008679206B2

(12) United States Patent
Wan

(10) Patent No.: US 8,679,206 B2
(45) Date of Patent: Mar. 25, 2014

(54) GRADED DRILLING CUTTERS

(75) Inventor: Shan Wan, Cincinnati, OH (US)

(73) Assignee: Diamond Innovations, Inc., Worthington, OH (US)

( * ) Notice: Subject to any disclaimer, the term of this patent is extended or adjusted under 35 U.S.C. 154(b) by 111 days.

(21) Appl. No.: 13/360,909

(22) Filed: Jan. 30, 2012

(65) Prior Publication Data

US 2012/0151846 A1 Jun. 21, 2012

Related U.S. Application Data

(62) Division of application No. 12/020,247, filed on Jan. 25, 2008, now abandoned.

(60) Provisional application No. 60/886,711, filed on Jan. 26, 2007.

(51) Int. Cl.

| | |
|---|---|
| ***B24D 3/00*** | (2006.01) |
| ***B24D 11/00*** | (2006.01) |
| ***B24D 18/00*** | (2006.01) |
| ***B24D 3/02*** | (2006.01) |
| ***C09K 3/14*** | (2006.01) |
| ***C09C 1/68*** | (2006.01) |

(52) U.S. Cl.
USPC ..... 51/297; 51/293; 51/307; 51/309

(58) Field of Classification Search
USPC ..... 51/297, 293, 307, 309
See application file for complete search history.

(56) References Cited

U.S. PATENT DOCUMENTS

| | | | | |
|---|---|---|---|---|
| 4,311,490 | A * | 1/1982 | Bovenkerk et al. | 51/307 |
| 4,604,106 | A * | 8/1986 | Hall | 51/293 |
| 4,694,918 | A * | 9/1987 | Hall | 175/430 |
| 5,037,704 | A * | 8/1991 | Nakai et al. | 428/550 |
| 5,135,061 | A * | 8/1992 | Newton, Jr. | 175/428 |
| 5,510,193 | A * | 4/1996 | Cerutti et al. | 428/552 |
| 5,547,767 | A | 8/1996 | Paidassi et al. | |
| 5,645,617 | A | 7/1997 | Frushour | |
| 5,723,177 | A | 3/1998 | Brandrup-Wognsen et al. | |
| 6,187,068 | B1 | 2/2001 | Frushour et al. | |
| 6,202,770 | B1 | 3/2001 | Jurewicz et al. | |
| 6,220,375 | B1 | 4/2001 | Butcher et al. | |
| 6,290,008 | B1 | 9/2001 | Portwood et al. | |
| 6,326,090 | B1 | 12/2001 | Schultz et al. | |
| 6,342,301 | B1 * | 1/2002 | Yoshida et al. | 428/408 |
| 6,346,689 | B1 | 2/2002 | Willis et al. | |
| 6,443,248 | B2 | 9/2002 | Yong et al. | |
| 6,533,831 | B2 | 3/2003 | Zimmer | |
| 6,571,889 | B2 | 6/2003 | Griffo et al. | |
| 6,601,662 | B2 | 8/2003 | Mathias et al. | |
| 6,641,893 | B1 | 11/2003 | Suresh et al. | |
| 6,655,882 | B2 | 12/2003 | Heinrich et al. | |
| 6,696,137 | B2 | 2/2004 | Yong | |

(Continued)

FOREIGN PATENT DOCUMENTS

| | | | |
|---|---|---|---|
| EP | 0774527 | A | 5/1997 |
| JP | S57175775 | A | 4/1982 |

(Continued)

*Primary Examiner* — James McDonough
(74) *Attorney, Agent, or Firm* — Frank Y Gao, Esq.

(57) ABSTRACT

In an embodiment, an abrasive compact includes ultra-hard particles which are sintered, bonded, or otherwise consolidated into a solid body. The compact also includes various physical characteristics having a continuous gradient, a multiaxial gradient, or multiple independent gradients.

17 Claims, 18 Drawing Sheets

(56) References Cited

U.S. PATENT DOCUMENTS

| | | | |
|---|---|---|---|
| 6,793,681 | B1 | 9/2004 | Pope et al. |
| 6,800,095 | B1 | 10/2004 | Pope et al. |
| 6,817,550 | B2 | 11/2004 | Taylor et al. |
| 6,892,836 | B1 | 5/2005 | Eyre et al. |
| 6,908,688 | B1 | 6/2005 | Majagi et al. |
| 6,951,578 | B1 | 10/2005 | Belnap et al. |
| 6,987,318 | B2 | 1/2006 | Sung |
| 2002/0029909 | A1 | 3/2002 | Griffo et al. |
| 2003/0191533 | A1 | 10/2003 | Dixon et al. |
| 2004/0040750 | A1 | 3/2004 | Griffo et al. |
| 2004/0137834 | A1 | 7/2004 | Webb et al. |
| 2004/0223676 | A1 | 11/2004 | Pope et al. |
| 2005/0133277 | A1 | 6/2005 | Dixon |
| 2005/0146086 | A1 | 7/2005 | Pope et al. |

FOREIGN PATENT DOCUMENTS

| | | | | | |
|---|---|---|---|---|---|
| JP | 02167668 | A | * | 6/1990 | ..... 51/297 |
| JP | H04037650 | A | | 2/1992 | |
| WO | WO2004103641 | A1 | | 12/2004 | |

* cited by examiner

GRADED DRILLING CUTTERS

CROSS REFERENCE TO RELATED APPLICATIONS

The present application is a division of U.S. patent application Ser. No. 12/020,247, filed Jan. 25, 2008 which is incorporated by reference in its entirety. U.S. patent application Ser. No. 12/020,247 claims the benefit of U.S. provisional patent application Ser. No. 60/886,711 filed Jan. 26, 2007.

BACKGROUND

1. Technical Field

This application relates to abrasive compacts with various physical characteristics, such as compacts having a continuous gradient, a multiaxial gradient, or multiple independent gradients.

2. Description of the Related Art

Abrasive compacts are widely used in drilling, boring, cutting, milling, grinding and other material removal operations. Abrasive compacts include ultra-hard particles sintered, bonded, or otherwise consolidated into a solid body. Ultra-hard particles may include natural or synthetic diamond, cubic boron nitride (CBN), carbo-nitride (CN) compounds, boron-carbon-nitrogen-oxygen (BCNO) compounds, or any material with hardness greater than that of boron carbide. The ultra-hard particles may be single crystals, polycrystalline aggregates or both.

In commerce, abrasive compacts are sometimes referred to as polycrystalline diamond (PCD), or diamond compacts when based on diamond. Abrasive compacts based on CBN are often called polycrystalline cubic boron nitride (PCBN) or CBN compacts. Abrasive compacts from which residual sintering catalysts have been partially or totally removed are sometimes called leached or thermally stable compacts. Abrasive compacts integrated with cemented carbide or other substrates are sometimes called supported compacts.

Abrasive compacts are useful for demanding applications requiring resistance to abrasion, corrosion, thermal stress, impact resistance, and strength. Design compromises for these abrasive compacts arise from the difficulty of attaching the abrasive compact to supporting substrates, sintering process limitations, or balancing inversely varying properties, such as the need for sintering additives and their effect on corrosion resistance. Prior art abrasive compacts use layered microstructures to overcome some of these design compromises. The prior art's transition between layers with different ultra-hard particle sizes is shown in FIG. 1, where a uniform fine particle region 111, with fine particles 114 and uniformly coarse region 112 and respectively 113, are visible. FIG. 2 shows the abrupt change in particle size of the compact of FIG. 1 that appears 550 microns from the active cutting surface of the cutter.

Prior art compacts also use abrupt chemical transitions. FIG. 3, an electron micrograph, illustrates a catalyst concentration change 213, 214 in a prior art supported abrasive compact. The catalyst metal depleted region 211 is near the active cutting surface 217. The catalyst metal is visible in the metal rich region 212 as a fine network of light gray lines. The transition also may be shown by electron beam microprobe analysis conducted along the line heading from one surface 215 to another 216. FIG. 4 graphically illustrates the five-fold reduction in catalyst concentration of the cutter of FIG. 3 along the line between surfaces 215 and 216. Both transitions take place over about one coarse grain diameter.

The abrupt transitions in physical properties or structure of prior art abrasive compacts are also supported by patent drawings of, for example, U.S. Pat. No. 5,135,061, U.S. Pat. No. 6,187,068, and U.S. Pat. No. 4,604,106, the disclosures of which are incorporated herein by reference in their entirety. The foregoing abrasive compacts all contain discrete layers of essentially uniform physical characteristics with abrupt transitions between the regions. Abrupt transitions in physical, chemical or structural characteristics can reduce performance of abrasive compacts.

SUMMARY

In an embodiment, an abrasive compact includes a plurality of superabrasive particles consolidated into a solid mass. The particles have a characteristic gradient that is continuous, monotonic and uniaxial.

Optionally, the characteristic gradient is a particle size gradient. Additionally, the maximum rate of change of particle size along an axis may be less than 1 micron of diameter per 1 micron of translation.

Alternatively, the characteristic gradient may be a pore size gradient. Additionally, the maximum rate of change of pore size along an axis may be less than 1 micron of diameter per 1 micron of translation.

As another option, the characteristic gradient may be a particle shape gradient. Additionally, the maximum rate of change of particle aspect ratio along an axis may be less than 0.1 per 1 micron of translation.

In yet another option, the characteristic gradient may be a superabrasive particle concentration.

In another embodiment, an abrasive compact includes superabrasive material consolidated into a solid mass. This mass has at least two characteristic gradients that are each continuous. The gradients may be (i) monotonic and uniaxial or (ii) oscillating.

In an embodiment, a method of creating an abrasive compact includes starting with a group of ultra-hard particles, such as a prepared synthetic diamonds, with a range of particle sizes. The particles are combined and mixed with alcohol or another fluid to create a mixed slurry. The slurry is allowed to settle or otherwise separate. The mixed slurry settles into a substantially solid, graded layer, optionally in which more of the coarse particles have first settled and more of the finest particles have settled last. Most, if not all, remaining liquid is removed by drying, centrifugation, or another method. A portion of the graded layer is then removed and processed by sintering, typically under HPHT conditions, to create an abrasive compact. A portion of the graded layer optionally may be placed against a substrate. The layer of ultra-hard particles may be oriented in order to place the surface having more coarse diamond particles near the substrate to create an initial assembly, which is processed by sintering, typically under HPHT conditions, to create a processed assembly. From this processed assembly, a sintered diamond abrasive compact supported on a cobalt cemented tungsten substrate is produced and recovered. The resulting supported sintered compact may be finished into an abrasive tool.

Optionally, the mixed slurry is allowed to separate in a non-planar fixture. Additionally, the substrate may have an interface surface matching the graded layer, and it may be placed against the portion of the compact having more fine particles.

BRIEF DESCRIPTION OF THE DRAWINGS

FIG. 13 is a graph of a particle size gradient, while

DETAILED DESCRIPTION

Figure 1:
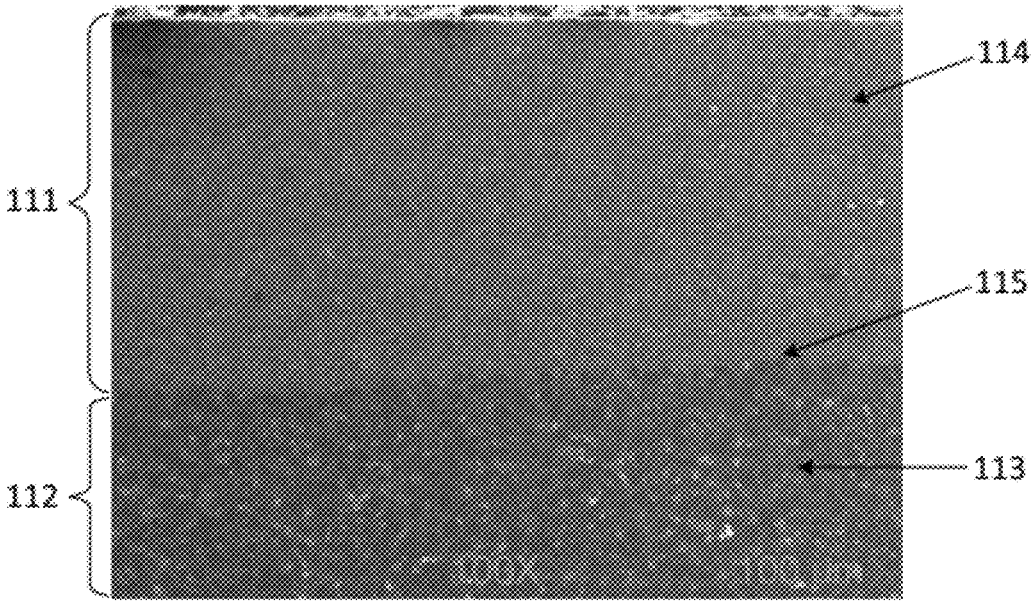
PRIOR ART FIG. 1
FIG. 1 is an electron micrograph of a prior art PCD compact structure, illustrating an abrupt transition and particle size.

Before the present methods, systems and materials are described, it is to be understood that this disclosure is not limited to the particular methodologies, systems and materials described, as these may vary. It is also to be understood that the terminology used in the description is for the purpose of describing the particular versions or embodiments only, and is not intended to limit the scope. For example, as used herein, the singular forms "a," "an," and "the" include plural references unless the context clearly dictates otherwise. In addition, the word "comprising" as used herein is intended to mean "including but not limited to." Unless defined otherwise, all technical and scientific terms used herein have the same meanings as commonly understood by one of ordinary skill in the art.

This disclosure deals with solid materials in which at least one characteristic, such as structure or another physical characteristics varies with position in the material. As used herein, the following terms have the following definitions:

Areal Average—an average of a measured characteristic assessed in a section of a compact oriented with respect to the gradient axis. The dimension perpendicular to the gradient axis is large enough give a good estimate of the characteristic, at least 30 coarse particle diameters, and in some cases 100 or more. The dimension parallel to the gradient should be small enough not to obscure the presence of discontinuities, such as at least 1 to 3 times the diameter of the coarsest particle in the section of interest.

Coarse Grain—The grain of a polycrystalline compact having the $99^{th}$ (largest) percentile diameter of those grains present in a sample area of a compact. Concomitant Gradients—multiple structural or physical characteristics that simultaneously vary as a function of position, or structural or physical characteristics that simultaneously vary along one or multiple axes of an object. A causal relationship exists between the gradients.

Continuous Gradient—a smooth gradient without abrupt transitions at the microstructural scale of the compact. A continuous gradient, described mathematically, may have a finite first positional derivative.

Continuous Characteristic Gradient—a characteristic that varies as a function of position at about or below the scale of the microstructure of the compact. A continuous characteristic exhibits a smooth positional dependence of the average of at least 30 randomly selected, different line intercept assessments of the characteristic along the gradient axis. Alternatively, a continuous characteristic gradient exhibits a smooth positional dependence of an areal average of the characteristic when the smaller dimension of the assessment area is oriented parallel to the gradient axis.

Continuous Variable—a variable in which changes occur in small increments such that large swings do not occur in a relatively small portion of the change. Gradient—a change in a structural or physical property based on position within a solid body. The definition encompasses structure and/or physical characteristic changes. A gradient is sometimes referred to herein as a "characteristic gradient," where the characteristic is the structural or physical property that changes.

Linear Gradient—a gradient in which particle size, chemical composition, or both change as a linear function of position.

Monotonic Gradient—a gradient in which a characteristic continually increases or decreases with position and does not oscillate.

Multiaxial Gradient—a gradient that varies along more than one axis.

Multimodal Gradient—more than one independent structural or physical characteristic gradients. The gradients may or may not have a casual relationship with each other. As a non-limiting example, a compact in which both ultra-hard particle size and composition simultaneously vary has a multimodal gradient.

Oscillating Gradient—a continuous gradient in which a characteristic repeatedly varies between limiting values as a function of position.

Ultra-hard Material—diamond, cubic boron nitride, or another material having a Vickers hardness of greater than about 3000 $kg/mm^2$, and optionally more than about 3200 $kg/mm^2$. Ultra-hard material is sometimes referred to herein as superabrasive material.

Uniaxial Gradient—a gradient along a single directional axis.

Unimodal Gradient—a gradient of a single structural or physical characteristic. As a non-limiting example, increasing ultra-hard particle diameter along a direction in an abrasive compact provides a unimodal gradient. Concomitant gradients along multiple axes of an object may be associated with a unimodal gradient.

In accordance with embodiments disclosed herein, an abrasive compact includes diamond, cubic boron nitride (CBN) or other particles of ultra-hard material consolidated into a solid mass. Any now or hereafter known consolidation method may be used to create the mass, such as sintering at elevated temperatures and pressures known as high pressure/high temperature (HPHT) conditions. For polycrystalline diamond (PCD) or polycrystalline CBN (PCBN), these conditions are typically over 4 gigapascal (Gpa) and temperatures over 1200° C. The abrasive compacts may be free standing, attached to a substrate to form a supported abrasive compact, and/or processed to form a thermally stable, or leached, abrasive compact.

Figure 5:
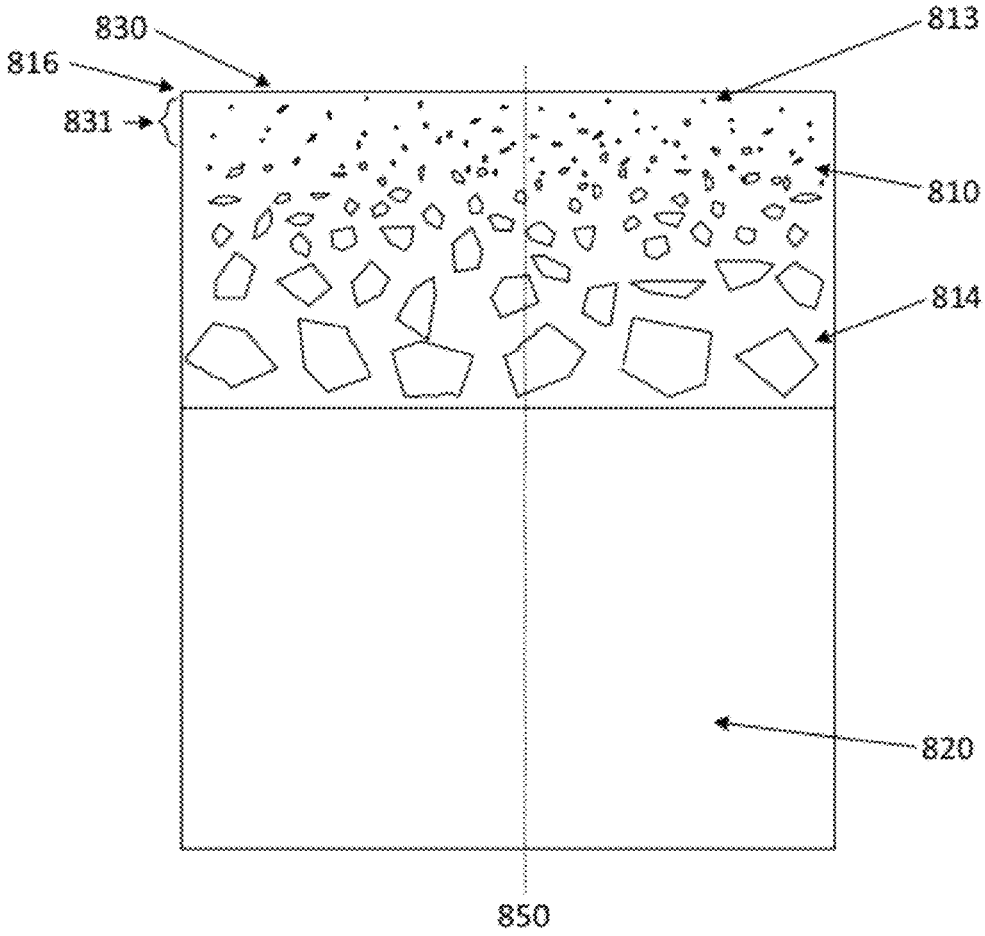
FIG. 5 is a diagram illustrating a cross section of an exemplary cylindrical supported abrasive composite.

In one form, an abrasive compact may have at least one continuous uniaxial characteristic gradient of a continuously distributed structural or physical characteristic. FIG. 5 is a schematic cross section of a cylindrical supported abrasive composite such as the type that may be used as a drilling cutter in an earth-boring bit. The section shown is parallel to the cylindrical axis 850 of the drilling cutter. Such cutters comprise a substrate 820 made of a supporting material such as cemented tungsten carbide, with a compact 810 of sintered ultra-hard particles coaxially attached to at least one end of the substrate. The free planar end 830 of the abrasive compact and a portion of the cylindrical abrasive compact side surface 831 are active cutting surfaces.

In embodiments described herein, the abrasive compact microstructure has a continuous size gradient of ultra-hard materials, typically in the form of particles. The gradient shown in FIG. 5 is substantially parallel to the cutter cylindrical axis 850. However, other positional gradients are possible, such as a gradient that extends inward from a corner 816 of the compact along a line that is offset at desired angles from top surface 830 and side surface 831. The illustrated unimodal, uniaxial gradient in ultra-hard particle size is an independent continuous characteristic gradient. A relatively high concentration of fine ultra-hard particles 813 provides high abrasive wear and fracture resistance near the cutting surface, while a relatively high concentration of coarser particles 814 will be present near the tungsten carbide substrate 820. The region of fine particles 811 may extend some axial distance toward the substrate 820 to encompass the entire active cutting surfaces 830 and 831. The linear or areal average particle size, measured as described above, smoothly and continuously increases axially toward the substrate 820.

Figure 6:
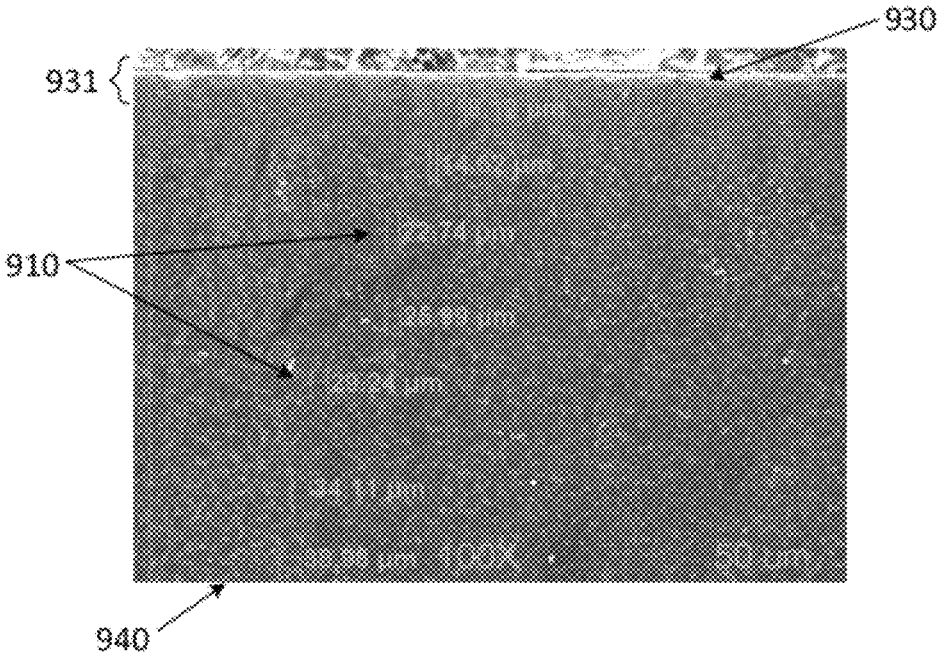
FIG. 6 is an electron micrograph illustrating an exemplary microstructure of an embodiment such as that of FIG. 5.

The micrograph of FIG. 6 shows one microstructure of an embodiment such as that schematically illustrated in FIG. 5. Ultra-hard particle sizes 910 are measured and recorded on micrograph. The active cutting surfaces 930 and 931 comprise ultra-hard particles that, in this example, are between about 6 and 8 microns in size for high abrasion resistance. Particles of other sizes may be used. The ultra-hard particle size continuously increases to about 40 microns in the direction toward the substrate interface 940. The ultra-hard particle size characteristic changes in a continuous gradient, and thus is distinctly different from prior art layered and discontinuous mixture gradients. In some embodiments, the maximum rate of change of the particle size gradient may be no more than 1 micron of particle size per 1 micron of translation (i.e., physical distance) along the gradient axis. An alternative gradient may be pore size, with a similar maximum rate of change.

Figure 7:
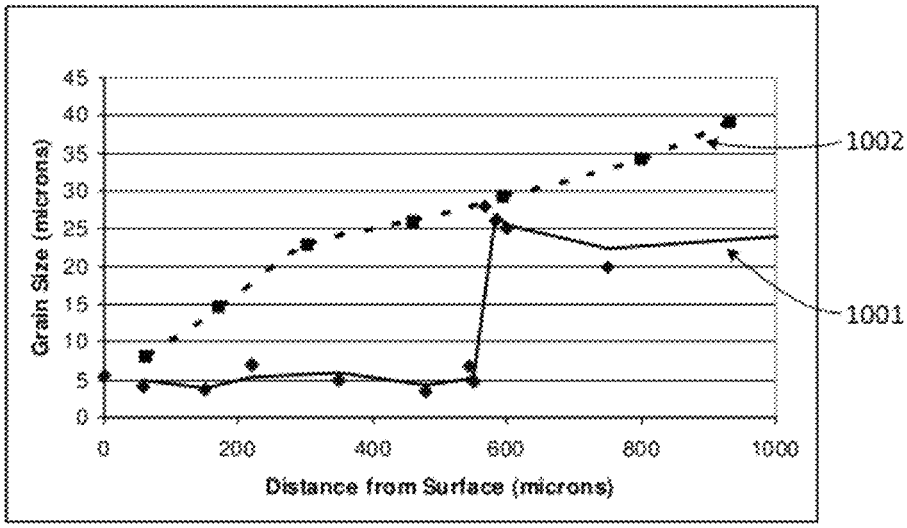
FIG. 7 is a graph comparing grain size as a function of distance from the cutting surface for the embodiments of FIG. 3 and FIG. 5.

FIG. 7 compares graphical presentations of the ultra-hard particle size transitions in prior art compacts 1001 (such as that shown in FIG. 3) and the embodiment of FIGS. 5 and 6 1002. The ultra-hard particle sizes are measured in a direction parallel to the cylindrical axis of the drilling cutter (axis 850 in FIG. 5). FIG. 7 shows a continuous gradient 1002 in ultra-hard particle size for the embodiment of FIG. 5, in clear contrast with the abrupt particle size transition 1001 of the prior art of FIG. 3. While the embodiment of FIG. 5 has a nominally linear gradient 1002 in particle size, a linear gradient is not required, nor should it limit the scope of the invention. This compact also may have several concomitant gradients: (i) a concomitant continuous, uniaxial gradient in wear resistance, a continuous variable; (ii) a concomitant, continuous, uniaxial composition gradient, a discontinuous variable; and (iii) others, such as catalyst metal pool size, thermal conductivity, and/or thermal expansion. The gradients described herein may encompass a portion of the abrasive compact volume as shown or the entire volume. The abrasive compacts described herein may achieve the objectives of prior art without the stress concentration or contamination of discrete interfaces of a layered structure. The abrasive compacts described herein are the first reduction to practice of a continuous, uniaxial gradient of a continuously distributed compact variable.

Another embodiment is an abrasive compact with multimodal gradients. These independent gradients may be continuous or not, and they may include continuously or discontinuously distributed structural or physical characteristics. The gradients may be monotonic or oscillating. As an example, an abrasive compact may contain independent gradients of continuously distributed sizes of ultra-hard particles and additive particles and discontinuously distributed composition characteristics.

Figure 8:
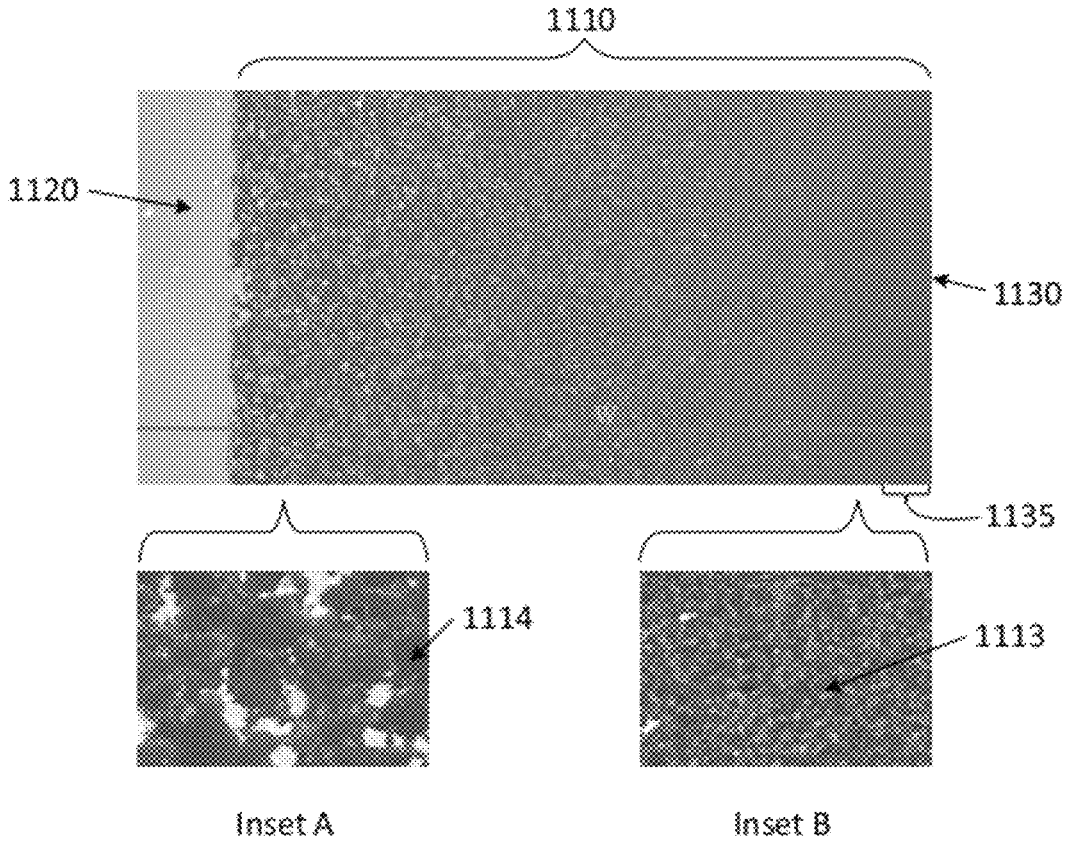
FIG. 8 includes electron micrographs of an exemplary cutter having multiple independent gradients, including high magnification insets.
Figure 9:
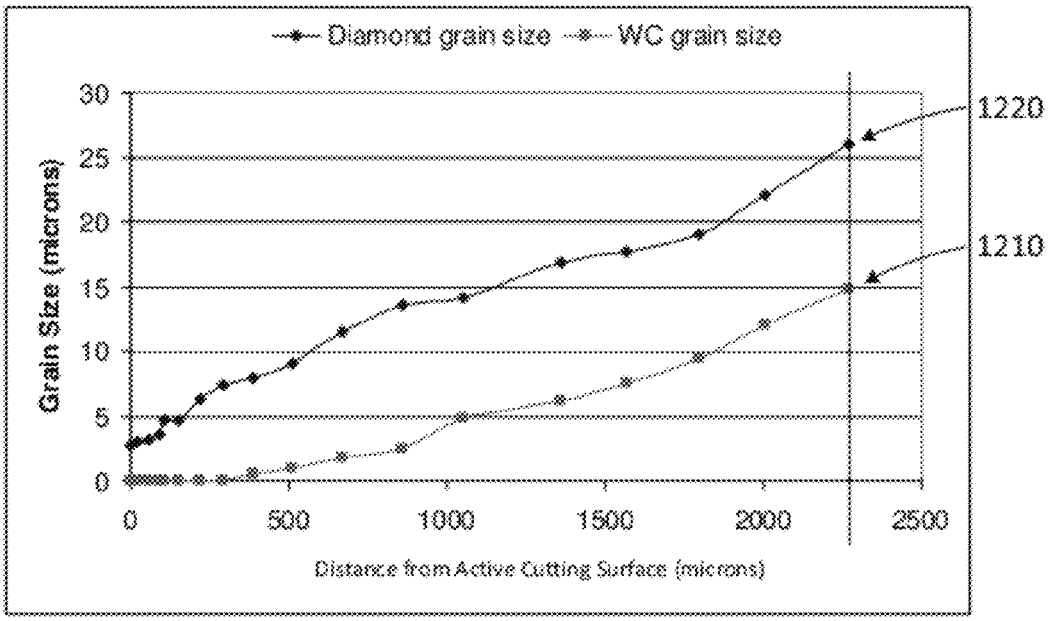
FIG. 9 is a graph illustrating grain size as a function of the distance from the active cutting surface, based on the embodiment of FIG. 8.

In such an embodiment, an example of which is shown in FIG. 8, a micrograph of a sectioned drilling cutter, illustrates an abrasive composite with multiple independent coaxial gradients, comprising a substrate 1120 of a tungsten carbide and/or other material with an abrasive compact 1110 of diamond and tungsten carbide and/or other material coaxially attached to the substrate. The free planar end 1130 of the abrasive compact and a proximal portion 1135 of the cylindrical abrasive compact surface are active cutting surfaces. As shown in the high magnification inset, 1115, fine ultra-hard particles 1113, in this example having a particle size below about 3 microns, comprise the active cutting surfaces, providing high abrasive wear and fracture resistance while coarser particles, shown in high magnification inset 1116, in this example having a particle size above about 20 microns 1114 improve HPHT sintering near the tungsten carbide substrate 1120. The region of fine ultra-hard particles extends some axial distance toward the tungsten carbide substrate 1120 to encompass an extended portion of active cutting surfaces 1135. The characteristic particle size gradient begins at about 3 microns average particle size and continuously increases axially from the free planar end 1130 toward the direction of the substrate 1120, achieving a final particle diameter of about 20 microns. FIG. 9 presents a graph illustrating the diamond size gradient 1220 as a function of distance from the free planar end and/or active cutting surface.

The second gradient set of this embodiment, independent from and coaxial with the previously described ultra hard particle size gradient comprises gradients in the characteristics of an additive, tungsten carbide. The tungsten carbide additive has both a particle size and mixture compositional gradient. As shown in the insets A and B of FIG. 8 and in the graph of FIG. 9, the average tungsten carbide particle size gradient 1210 continuously decreases from about 15 microns 1114 near the tungsten carbide substrate 1120 to nearly 0 microns 1113, meaning very little tungsten carbide is present, at the active cutting surface 1130. The continuous tungsten carbide composition gradient, coaxial with ultra-hard particle size gradient, decreases from about 50 weight percent near the tungsten carbide substrate 1120 to approximately 0% at the planar end and/or active cutting surface 1130.

Figure 10:
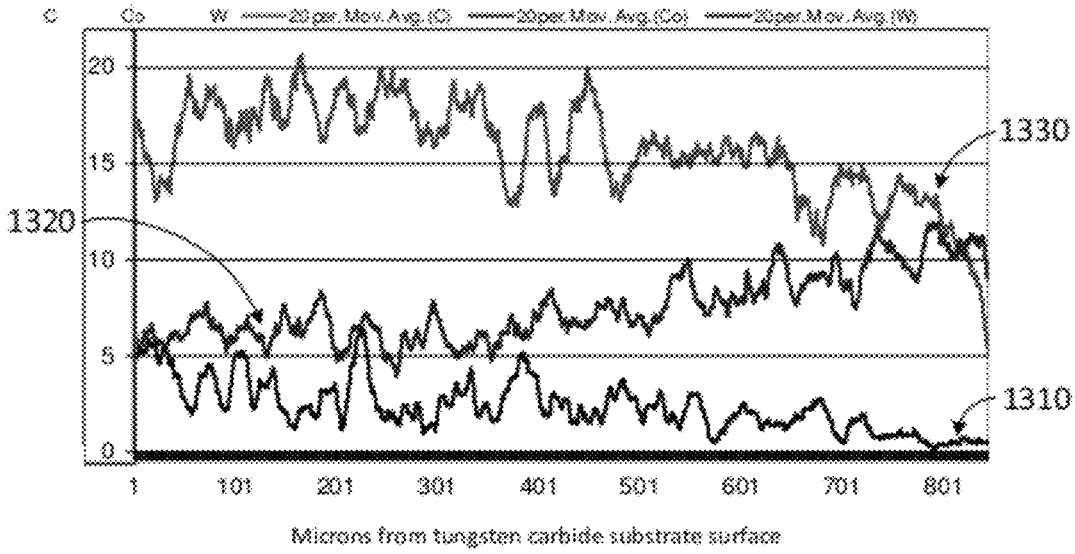
FIG. 10 is a graph showing tungsten content, catalyst metal concentration, and particle size gradients in an exemplary cutter.

FIG. 10, an elemental concentration microanalysis, shows the independent nature of these gradients in arbitrary composition units. The tungsten carbide, measured as elemental tungsten, content 1310 of the abrasive compact decreases in an axial direction moving away from the tungsten carbide substrate. An independent ultra-hard particle size gradient 1320 also may show a decrease with distance from the substrate, while the cobalt catalyst metal concentration 1320 may increase in the same direction. As in the prior embodiment, other concomitant gradients, such as cobalt particle size or diamond concentration, may be present. The independent gradients may encompass a portion or the complete volume of the abrasive compact. The multimodal gradients may provide additional compact design flexibility while reducing the contamination and stress concentration of the prior art.

Figure 11:
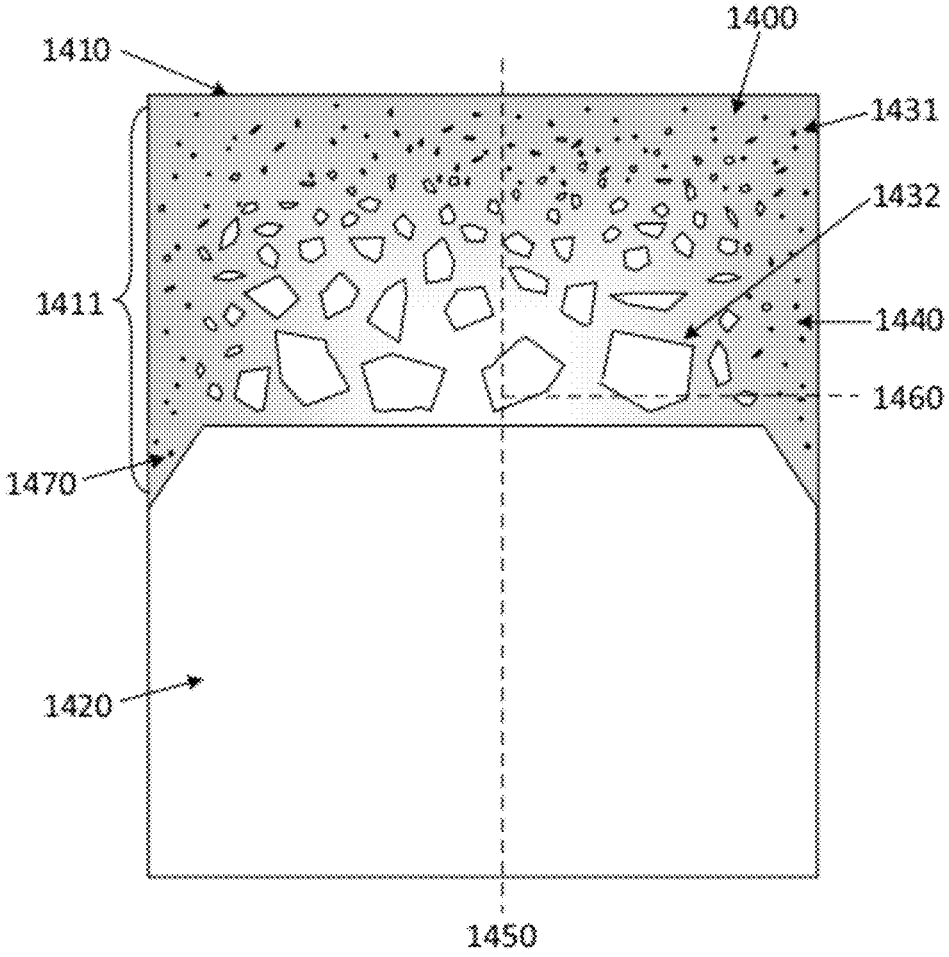
FIG. 11 is a schematic section of a supported abrasive compact with multimodal gradients present on multiple axes.

Yet another embodiment comprises independent continuous gradients on multiple axes within the abrasive compact. These gradients may be of any type previously mentioned. FIG. 11 is a schematic section of a supported abrasive compact 1400 with multimodal gradients present on multiple axes. The schematic section intersects the cylindrical axis 1450 of the compact. A radial direction is also shown 1460. The exterior of the abrasive compact comprises a planar active cutting surface 1410 and a circumferential surface 1411, a portion of which may be an active cutting surface. Ultra-hard particles, which may in embodiments range from fine 1431 to coarse 1432 are present in the abrasive compact. A second gradient, such as a composition gradient, a property, or other gradient 1440 is present in the abrasive compact. This second gradient characteristic is illustrated by changing shade. Non-planar features 1470 may be present at the interface of the supporting substrate 1420 and the abrasive compact 1400. In this non-limiting example it is seen that particles of essentially one size are present at the exterior surface of the abrasive compact. Note that the particles need not be exactly the same size but merely need to be closely similar in size, such as by a 10 percent or less variation, a 5 percent or less variation, or a one percent or less variation. Particles of a different size may be present at the interior. The particles may change average or mean size on more than one axis and the rate of particle size change may vary on different axes, such as axial 1450, radial 1460 or other directions. Other characteristic gradients may include concomitant gradients in catalyst metal concentration; catalyst metal distribution; ultra-hard particle concentration the amount or fraction of the compact that is porous, known as pore fraction; the size of the pores present in the compact, known as pore size; and shape distributions and derivative gradients in other physical characteristics. The second gradient 1440 may be a gradient of any of the types mentioned above, for example a gradient in the concentration or particle size of an additional phase. The multiple gradients may be oscillating, monotonic, linear or of other types.

Figure 12:
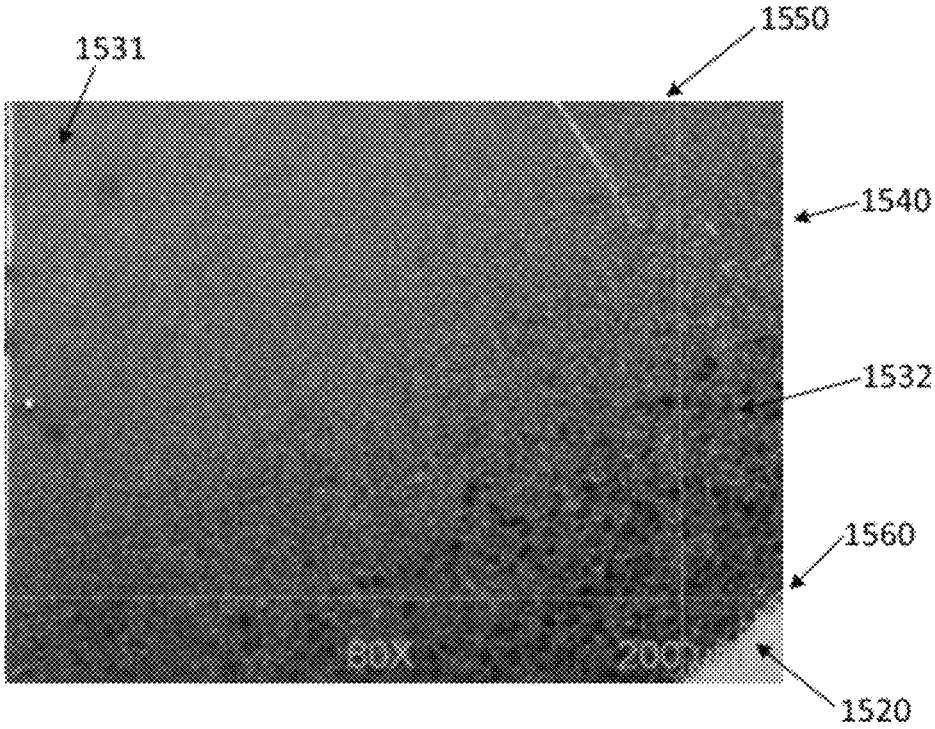
FIG. 12 is a micrograph of a gradient from a region of the cutter of FIG. 11.

FIG. 12 is a micrograph of an actual multiaxial, multimodal gradient from the region 1470 of FIG. 11. The direction parallel to the cutter cylindrical axis 1550 and the radial direction 1560 are indicated. The supporting substrate 1520, coarse ultra-hard abrasive grains 1532 and fine ultra-hard abrasive grains 1531 are shown. Radial and axial ultra-hard particle size gradients are present. The rate of change of the particle size also varies with the axis chosen.

Figure 13:
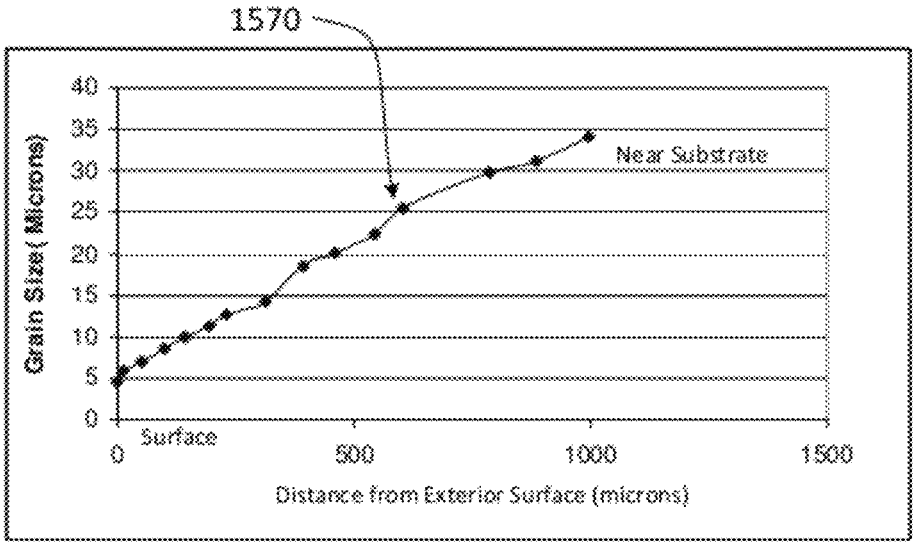
Figure 14:
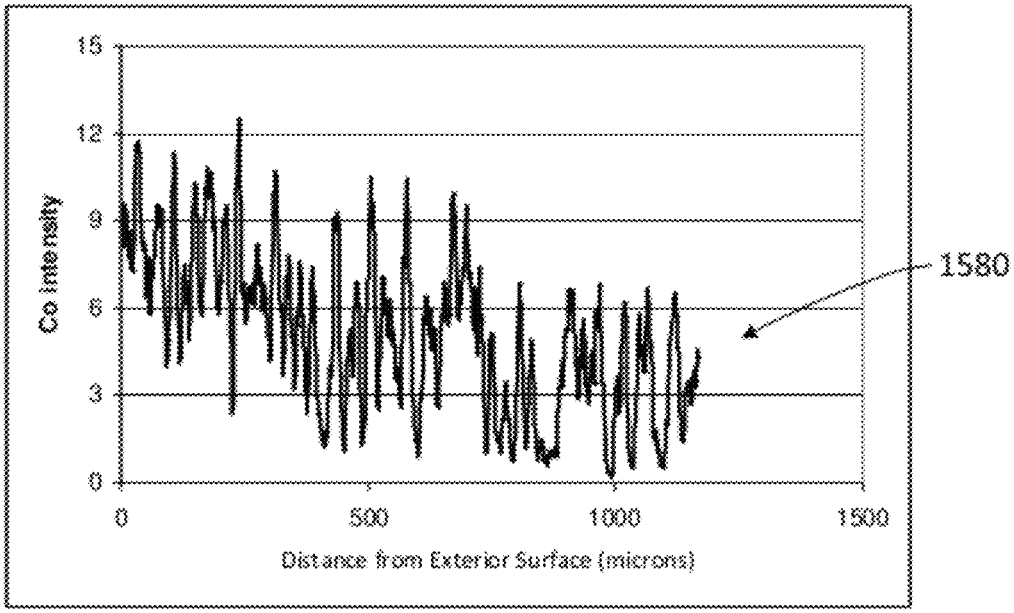
FIG. 14 shows catalyst metal concentration, in one direction for the exemplary cutter of FIG. 12.
Figure 15:
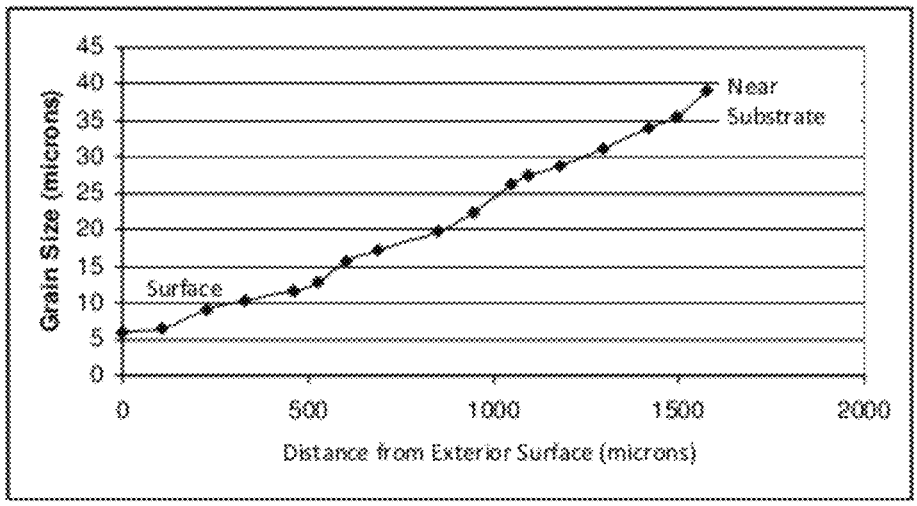
FIGS. 15 and 16 show catalyst metal concentration and particle size gradients of the exemplary cutter of FIG. 12 in a direction that is different from that shown in FIGS. 13 and 14.
Figure 16:
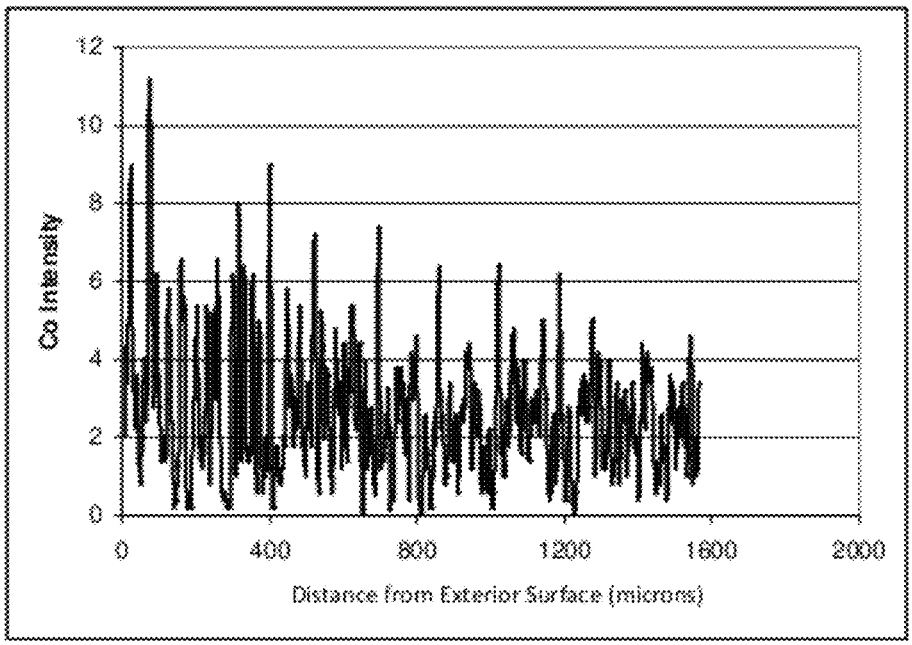

FIG. 13 shows the smooth axial gradient 1570 in ultra-hard particle size from about 5 microns near the exterior of the compact to about 35 microns near the carbide substrate 1520. FIG. 14 shows the catalyst metal concentration gradient 1580 in the same direction as assessed by a single line scan. The variability in the catalyst concentration, due much lower level of catalyst present in the abrasive particles, does not obscure the presence of the gradient. The variability may be reduced by averaging a statistically significant number of line scans parallel to the gradient or areal assessment as described previously. FIGS. 15 and 16 show the same physical characteristic gradients in the radial direction. A lower rate of change is present in the radial direction. Multiaxial gradients further enhance design flexibility.

One form of multiaxial gradients may be found in an abrasive compact where an entire surface or volume, for example the entire exterior surface, has at least one substantially uniform physical characteristic, while having gradients in other regions. As an example, this embodiment may include a supported abrasive composite for an earth boring bit cutter having a uniform ultra-hard particle size on all exterior surfaces with interior gradients to improve sintering or manage stresses. In such an embodiment, concomitant gradients may be present. This embodiment may further improve design flexibility while eliminating undesirable preferential wear during cutter service.

In another embodiment, the several structural or physical characteristics may vary in some, but not all directions. For example, a continuous axial composition gradient may coexist with a radial ultra-hard particle size gradient. In such an embodiment, concomitant gradients may be present.

In still another form, the compacts described herein may exhibit a discontinuous gradient of other phases mixed with ultra-hard particles. In one example, cutting tools for machining reactive metals require supported abrasive compacts with active cutting surfaces unreactive toward the workpiece and simultaneous high reactivity toward the substrate. Additions of aluminum oxide in the abrasive composite can advantageously reduce the cutting surface reactivity, but may also disadvantageously reduce the interfacial bond strength between the abrasive composite and a tungsten carbide substrate. The abrasive compacts of various embodiments may have an aluminum oxide rich active cutting surface that continuously changes to a lower aluminum oxide concentration composition at the substrate interface. In this way, a cutting tool may have improved life, little or no undesirable abrupt transitions, and strong attachment to a tungsten carbide substrate.

One other embodiment incorporates particle shape gradients. Particles in an abrasive compact may have various shapes. Aspect ratio, the numeric ratio between the major and minor axes or diameter of a particle, may be used to quantify particle shape. An abrasive compact with a particle shape gradient may have a volume or region of the compact comprised of particles that have a spherical or blocky, shape that changes to a more oblate, planar, whiskery shaped in another volume or region. An abrasive compact may have a region with low aspect ratio particles that, through a continuous gradient, becomes a region with high aspect ratio particles such as platelets or whiskers. The higher aspect ratio regions may offer different fracture, strength, or tribological, chemical, or electrical characteristics. In some embodiments, the maximum rate of change of the aspect ratio may be no more than 0.1 per one micron of translation (i.e. distance) along an axis.

In another embodiment, electrical conductivity and wear resistance gradients provide ultra-hard particle abrasive compacts for machining manufactured wood products. For these applications, a diamond based abrasive compact with a high level of bulk electrical conductivity is desirable to facilitate electronic spark machining of diamond cutters. Also for this application, high wear resistance is derived from a structure with a maximum content of coarse diamond particles. When such coarse diamond particles are incorporated in a monolithic, homogenous abrasive compact, electronic spark machining becomes more difficult. This embodiment solves this problem with coarse ultra-hard particles at active cutting surfaces with a gradient to finer ultra-hard particles and concomitant higher electrical conductivity. The continuous uniform gradient of particle size may provide a high bulk electrical conductivity with highly abrasion resistant wear surfaces.

Another embodiment applies the invented continuous gradients to other shapes. Annular abrasive compact geometries are suited to wire drawing dies. In these abrasive compacts structural or physical characteristics will be varied to produce an annular surface with the desired properties. In annular shapes, some of the gradients will be approximately perpendicular (radial) to tapered cylindrical or toroidal wear surfaces.

While compositional and ultra-hard particle size gradients have been described, other gradients will have utility. Unimodal, multimodal, uni- and/or multi-axial gradients of potential use are: phase composition, particle shape, electrical conductivity, thermal conductivity or expansion, acoustic and elastic properties, incorporation of other than ultra hard particle materials, density, porosity size and shape, strength, fracture toughness, optical properties.

In an embodiment, a method of creating an abrasive compact includes starting with a group of ultra-hard particles, such as a prepared synthetic diamonds, with a range of particle sizes. The particles are combined and mixed with alcohol or another fluid to create a mixed slurry. The mixed slurry is allowed to segregate as influenced by gravity, centrifugal force, an electrical field, a magnetic field or another method. The mixed slurry settles into a substantially solid, graded layer, optionally in which more of the coarse particles have first settled and more of the finest particles have settled last. Some, if not all, remaining liquid is removed by drying, centrifugation, or another method. A portion of the graded layer is then removed and optionally placed on a substrate. The layer of ultra-hard particles may be oriented in order to place the surface having more coarse diamond particles near the substrate to create an initial assembly, which is processed by sintering, typically under HPHT conditions, to create a processed assembly. From this processed assembly, a sintered diamond abrasive compact supported on a cobalt cemented tungsten substrate is produced and recovered. The resulting supported sintered compact may be finished into an abrasive tool.

Figure 20:
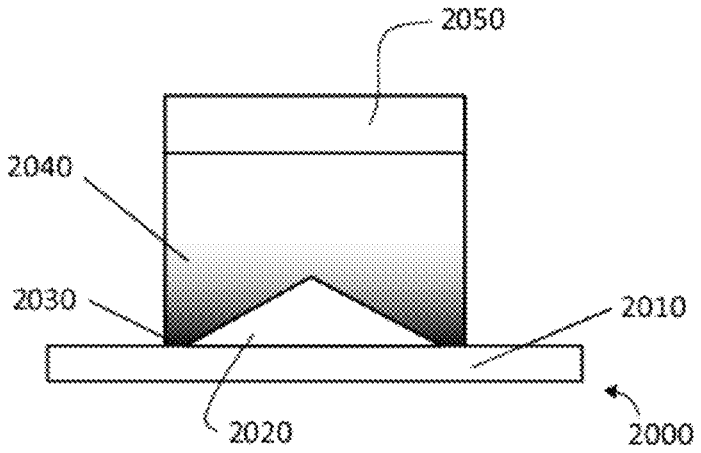
FIG. 20 illustrates a compact and an exemplary settling fixture.

Optionally, the mixed slurry is allowed to separate in a non-planar fixture. An example of the non-planar elements of a fixture 2000 is shown in FIG. 20. As shown in FIG. 20, the fixture 2000 may include a planar portion 2010 and non-planar portion 2020. The non-planar portion may be of any non-planar shape, such as that of two ramps meeting at a peak, a conical shape, a hemispherical shape, a pyramidal shape, or another non-planar shape. A larger concentration of coarse particles 2030 will settle near the non-planar structure, while a larger concentration of fine particles 2040 will settle at higher points away from the non-planar structure. Also optionally, the carbide or other substrate may have an interface surface size and shape matching the size and shape of the settled diamond layer against which it is placed.

EXAMPLES

Example 1 Prior Art

Figure 2:
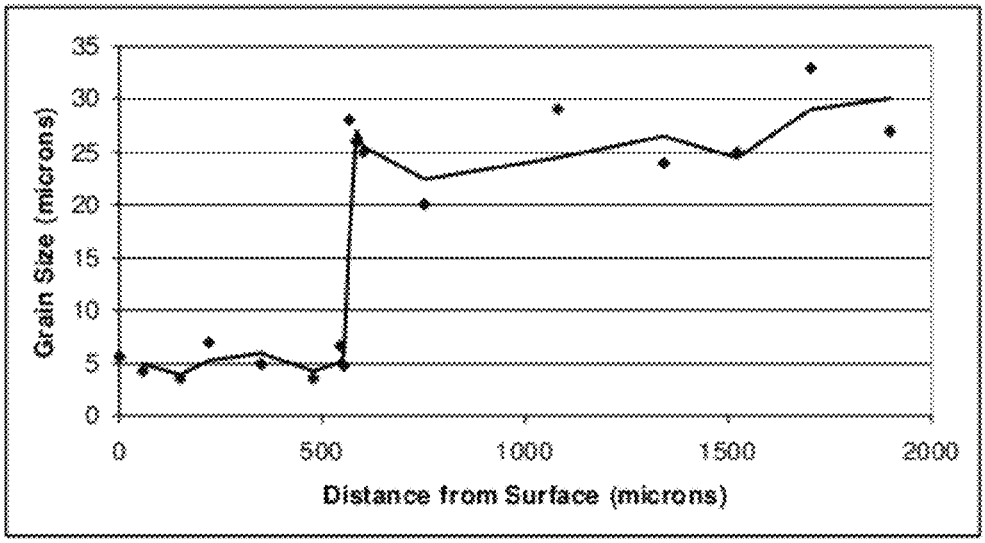
PRIOR ART FIG. 2
FIG. 2 is a graph showing particle size transition as a function of distance from cutting surface, which is relevant to the cutter of FIG. 1.

Following the procedures of U.S. Pat. Nos. 3,831,428; 3,745,623; and 4,311,490. MBM® grade, 3 micron diameter synthetic diamond from Diamond Innovations, Inc. was placed in a 16 millimeter (mm) diameter high purity tantalum foil cup to a uniform depth of approximately 1.5 mm. On top of this fine layer a second 1.5 mm uniformly thick layer of 40 micron MBM powder was added. A 16 mm cylindrical 13 weight-percent (wt %) cobalt cemented tungsten carbide substrate was also placed into the tantalum foil cup. This assembly was processed following the cell structure and teachings of cited patents at a pressure of 55-65 Kbar at about 1500° C. for about 15-45 minutes. The recovered supported abrasive compact had a sintered diamond layer structure supported on the cemented carbide substrate. The structure of this cutter is shown in FIGS. 1 and 2.

Example 2 Prior Art

Figure 3:
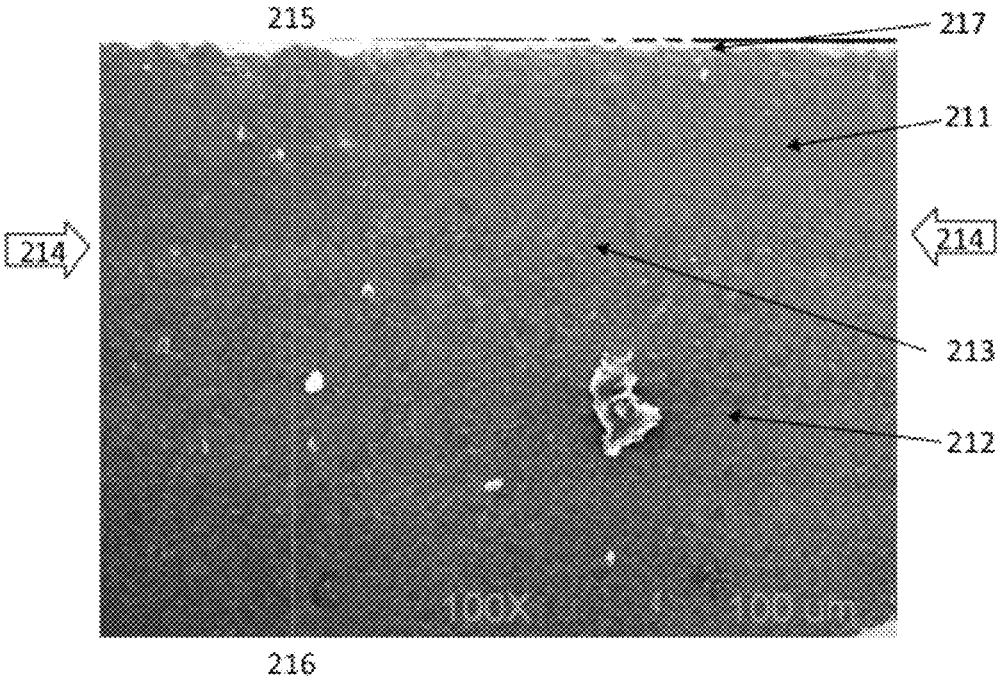
PRIOR ART FIG. 3
FIG. 3 is an electron micrograph illustrating an abrupt catalyst concentration change in a prior art thermally stable supported abrasive composite.
Figure 4:
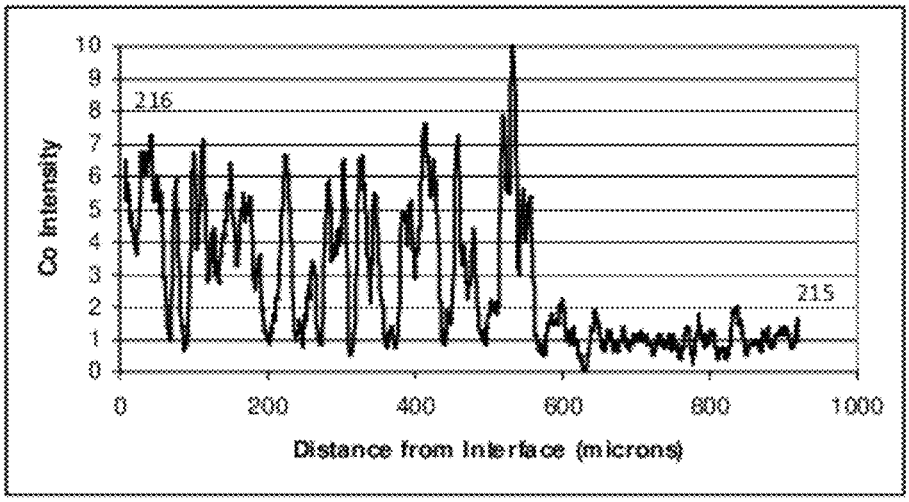
PRIOR ART FIG. 4
FIG. 4 is a graph of cobalt catalyst concentration as a function of the distance from the cutter interface, which is relevant to the cutter of FIG. 3.

A drilling cutter may be boiled in $3HCl:1HNO_3$ acid using methods such as those described in U.S. Pat. No. 4,224,380 with its carbide substrate covered by a protective layer to yield a cobalt depleted region. The structure such a cutter is shown in FIGS. 2 and 3.

Example 3

Figure 17:
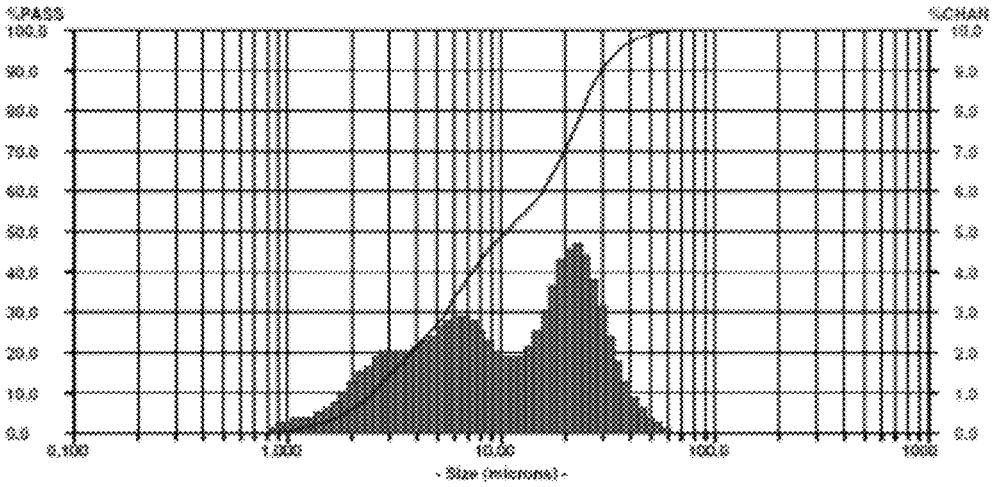
FIG. 17 is a graph showing particle size distribution of the exemplary cutter of Example 3 presented herein.
Figure 18:
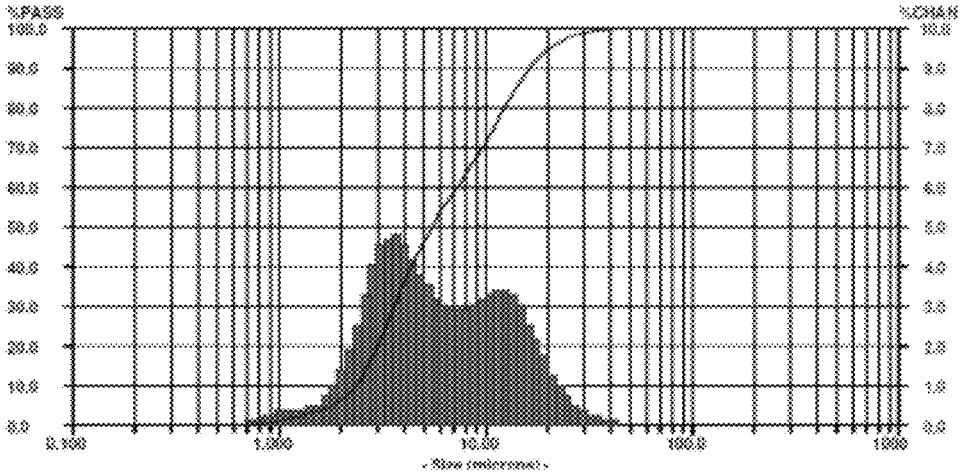
FIG. 18 is a graph illustrating particle size distributions of the diamond powder used in Example 4.

45 grams of synthetic diamond with a particle size distribution shown in FIG. 17 may be prepared and combined with 450 cc of 99.9% pure isopropyl alcohol. These materials may be mixed in a TURBULA® mixer for 2 minutes. The mixed slurry may be poured into a 100 mm diameter plastic container and allowed to settle for 8 hours. The remaining liquid may be carefully removed by decanting and evaporation. Once the settled diamond layer is solid, a 16 mm disc may be cut out of the settled layer. The diamond layer may be oriented in a tantalum (Ta) foil cup to place the coarse particles near the tungsten carbide substrate. A cylindrical cobalt cemented tungsten carbide substrate may be placed on top of the coarse diamond particles. This assembly may be processed using HPHT processing at a pressure of 55 to 65 Kbar at about 1500° C. for about 15 to 45 minutes. The exact conditions depend on many variables, these are provided as guidelines. The recovered assembly will produce a sintered diamond abrasive compact supported on a cemented tungsten carbide substrate, which may be finished into an abrasive tool. A sample of such a structure was cut axially in half and polished for structure evaluation, the structure of this example is shown in FIG. 6.

To demonstrate the utility of this example's uniaxial continuously graded structure, several cutters were prepared and tested for impact and abrasion resistance. These results were compared to Diamond Innovations, Inc. TITAN commercial drilling cutters. Impact testing was performed on an INSTRON 9250 drop tester. Abrasion resistance (volumetric efficiency or G-ratio) was measured by turning a granite cylinder with a sharp, unchamfered cutter. The cutter of this example outperformed commercial abrasion cutters by over 100% in impact performance and 500% in abrasion. Detailed test results are shown in Table 1.

TABLE 1

| | Graded cutter | Commercial cutter |
|---|---|---|
| Average Abrasion G-Ratio (10^5) | 85 | 15 |
| Average diamond table Impact damage after 10 drops at 20 J | 6.3% | 13.0% |

Example 4

Figure 19:
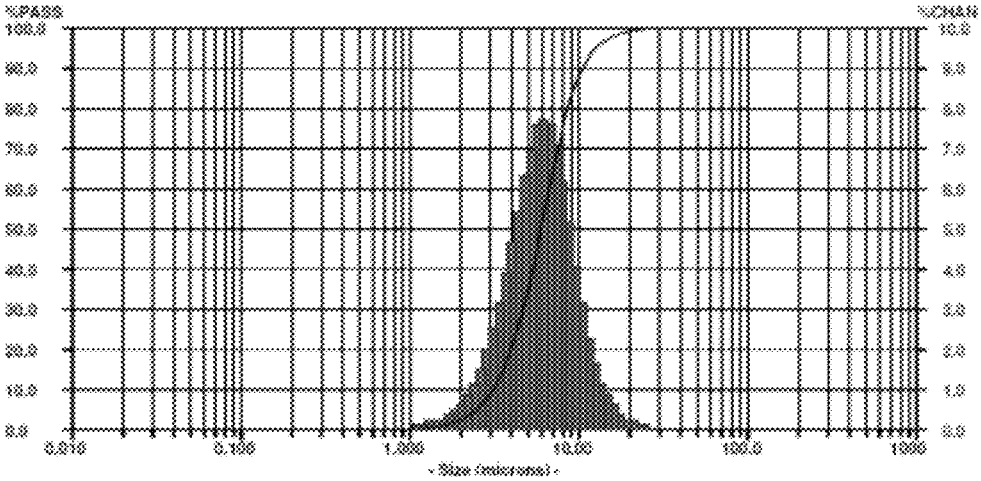
FIG. 19 is a graph illustrating particle size distributions of the tungsten powder used in Example 5.

45 grams of synthetic diamond powder with the particle size distributions shown in FIG. 19 were combined with 12 grams of (99% purity and source) tungsten powder with the particle size distribution shown in FIG. 19 as in Example 3. The fabrication and sintering processes were according to those of Example 3. The recovered composite compact had a sintered diamond layer structure supported on the cemented carbide substrate and could be finished for an abrasive tool. One sintered tool was cut and polished for structure evaluation. The microstructure of this example is shown in FIG. 8.

Example 5

The settled diamond layer process of Example 3 was duplicated with the exception that the slurry was allowed to separate in a non-planar fixture as shown in FIG. 20 for 8 hours. As shown in FIG. 20, coarse particles 2030 settled primarily near the non-planar structure, while fine particles 2040 primarily separated above the non-planar structure. The drying and assembly process of Example 3 was performed except that a cylindrical cobalt cemented tungsten carbide substrate 2050 with an interface surface matching the size and shape of an interface surface of the settled diamond layer surface was placed on top of the diamond particles. Sintering of Example 3 was duplicated. The recovered composite compact had a sintered diamond layer structure supported on the cemented carbide substrate and could be finished for an abrasive tool. One sintered tool was cut and polished for structure evaluation. The microstructure of this example is shown in FIG. 12.

The examples described above are not limiting. While sedimentation is described, other methods may be employed, such as centrifugation, percolation, vibration, magnetic, electrostatic, electrophoretic, vacuum, and other methods. It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art which are also intended to be encompassed by the following claims.

The invention claimed is:

1. A method of creating an abrasive compact, comprising:

combining ultra-hard particles with a fluid to create a mixed slurry;

allowing the mixed slurry to separate and form a graded layer;

removing remaining liquid from the graded layer;

selecting a portion of the graded layer;

placing a substrate against the selected portion of the graded layer to create an initial assembly;

processing the initial assembly to produce a sintered abrasive compact supported on the substrate to form a recovered assembly.

2. The method of claim 1 where further comprising the step of finishing the supported sintered compact into an abrasive tool.

3. The method of claim 1, wherein the allowing comprises allowing the mixed slurry to settle in a non-planar fixture; and wherein the placing comprises placing an interface surface of the substrate so that the interface surface matches a surface of the graded layer.

4. The method of claim 1, wherein the placing comprises orienting the graded layer and the substrate so that a surface of the substrate having more coarse particles is near the substrate.

5. The method of claim 1, wherein said compact comprises a plurality of superabrasive particles consolidated into a solid mass, the particles having a characteristic gradient that is continuous, monotonic and uniaxial.

6. The method of claim 5, wherein the characteristic gradient comprises a particle size gradient.

7. The method of claim 5, wherein a maximum rate of change of particle size is less than 1 micron of particle size per 1 micron of translation.

8. The method of claim 5, wherein the characteristic gradient comprises a pore size gradient.

9. The method of claim 8, in which a maximum rate of change of pore size is less than 1 micron of diameter per 1 micron of translation.

10. The method of claim 5, wherein the characteristic gradient comprises a particle shape gradient.

11. The method of claim 6, in which a maximum rate of change of particle aspect ratio is less than 0.1 per 1 micron of translation.

12. The method of claim 5, wherein the characteristic gradient comprises a concentration of the superabrasive particles.

13. The method of claim 1, wherein the abrasive compact comprises a plurality of superabrasive particles consolidated into a solid mass, the mass having a first continuous gradient along a first axis of the mass and a second continuous gradient along a second axis of the mass.

14. The method of claim 13, wherein each of the gradients comprises a particle size gradient.

15. The method of claim 9, wherein the first continuous gradient comprises a particle size gradient and a second continuous gradient comprises one of a pore size gradient, a particle shape gradient, or a superabrasive particle concentration gradient.

16. The method of claim 15, wherein the first continuous gradient is monotonic and uniaxial.

17. The method of claim 15, wherein the first continuous gradient is oscillating.

* * * * *